US006349496B1

(12) United States Patent
Neely

(10) Patent No.: US 6,349,496 B1
(45) Date of Patent: Feb. 26, 2002

(54) SAFETY LOCKING DEVICE FOR A FIREARM

(76) Inventor: George Joseph Neely, 8334 E. Gum Rd., Murfreesboro, TN (US) 37127

( * ) Notice: Subject to any disclaimer, the term of this patent is extended or adjusted under 35 U.S.C. 154(b) by 0 days.

(21) Appl. No.: 09/387,295

(22) Filed: Aug. 31, 1999

(51) Int. Cl.[7] ..... F41A 17/00
(52) U.S. Cl. ..... 42/70.11; 42/70.07
(58) Field of Search ..... 42/70.11, 70.06, 42/70.07, 1.01

(56) References Cited

U.S. PATENT DOCUMENTS 2,599,132 A * 6/1952 Sass ..... 42/70
2,742,726 A * 4/1956 Feller ..... 42/70
3,550,822 A * 12/1970 Lloyd ..... 224/2
3,624,945 A * 12/1971 Foote ..... 42/1
4,030,221 A * 6/1977 Doobenen et al. ..... 42/1
4,858,799 A * 8/1989 Young ..... 224/243
5,417,000 A * 5/1995 Chen ..... 42/70.06
5,437,119 A * 8/1995 Womack ..... 42/70.07
5,561,935 A * 10/1996 McCarthy et al. ..... 42/70.07
5,638,627 A * 6/1997 Klein et al. ..... 42/70.06
5,779,114 A * 7/1998 Owens ..... 224/193
5,829,179 A * 11/1998 Carter et al. ..... 42/70.07
5,918,402 A * 7/1999 Weinraub ..... 42/70.07

* cited by examiner

*Primary Examiner*—Michael J. Carone
*Assistant Examiner*—Michelle Thomson

(57) ABSTRACT

A safety locking device for engaging the trigger guard assembly of a firearm. A preferred embodiment includes a housing having a slot formed therein and configured to receive the trigger and trigger guard portion of a firearm, and a locking mechanism to prevent removal of the firearm from the device. The locking mechanism further comprises a locking assembly operably attached to a locking rod which can be moved into or out of a channel containing a ball that when held in place by the rod causes the slot that contains the trigger guard to narrow sufficiently to prevent the removal of the trigger guard and thus the firearm. The lock may comprise a conventional key-operated lock or an electronic lock. The locking device is designed primarily to be incorporated into a holster.

8 Claims, 12 Drawing Sheets side view front view side view front view

SAFETY LOCKING DEVICE FOR A FIREARM

REFERENCES

| U.S. PATENT DOCUMENTS | | |
|---|---|---|
| 2,599,132 | Sass | Apr 13,1950 |
| 2,742,726 | Feller | Apr 10, 1953 |
| 4,084,341 | Cervantes | Apr 18, 1978 |
| 5,283,971 | Fuller et al. | Feb 8, 1994 |
| 5,392,552 | McCarthy et al. | Feb 28, 1995 |
| 5,450,684 | Harris | Sept 19, 1995 |
| 5,417,000 | Chen | May 23, 1995 |
| 5,544,440 | Stockman | Aug 13, 1996 |
| 5,638,627 | Klein et al. | Jun 17, 1997 |
| 5,621,996 | Mowl, Jr. | Apr 22, 1997 |
| 5,724,760 | Langner | Mar 10, 1998 |
| FOREIGN PATENT DOCUMENTS | | |
| GB 2217437A | Tucker | 25.10.1998 |

PRIOR APPLICATION

Ser. No. 08/979,201 now abandoned.

BACKGROUND OF THE INVENTION

1. Field of the Invention

The present invention relates generally to safety devices such as trigger locks and breech locks for firearms to prevent the trigger mechanism or other working components of a firearm from being inadvertently actuated or actuated by an individual not appreciating the consequences of discharging a firearm.

2. Description of the Related Art

The art to which the invention relates, therefore, includes trigger locks, cable locks, breech locks and other devices designed to effectively disable the working mechanisms of a firearm to prevent its discharge. Such devices are commonly used in conjunction with firearms such as pistols, revolvers, and rifles to safely disable the firearm and prevent children or other individuals unable to appreciate the consequences of discharging a firearm from doing so.

In the case of trigger locks, the lock generally overlies the trigger guard as well as the trigger of the firearm. When the trigger lock mechanism is operably attached to a firearm, it obstructs a user's access to the trigger mechanism and cannot be removed from the firearm without a key to disengage it therefrom. Thus, when the trigger lock is engaged and attached to a firearm, a user is prevented from squeezing the trigger.

Cable locks and breech locks are designed to prevent the operation of the firearm by preventing the firearm from being placed in the "cocked" and ready to fire position. For example, a cable lock is designed to engage the action of a pistol or cylinder of a revolver and prevent it from chambering a cartridge to be fired. Similarly, a breech lock prevents a cartridge from being chambered by blocking the open end of the barrel, often referred to as the chamber or bore, and thus preventing a cartridge from being placed in the ready to fire position.

One common drawback associated with all of the aforementioned locks is the inability of such locks to hold a firearm securely within a holster. In addition,the inconvenience of having a separate safety and storage device. Another common problem associated with such locks is an apparent inability to disengage the firearm lock rapidly. For example in an emergency situation where a firearm is needed to repel an intruder, or in the law enforcement environment where a peace officer is apprehending a criminal, a trigger lock mechanism of the aforementioned type would prevent quick access to the weapon to repel the attack or stop the crime. Thus, trigger lock mechanism of this type are believed to be impractical for situations in which quick access to the firearm is required.

Another well known problem associated with trigger locks and other conventional firearm locking devices is the inability to store a firearm in a substantially ready position secured within a holster in which it is carried in order to prevent children and others from operating the firearm. For example, a law enforcement officer must have immediate access to his firearm in an emergency situation , yet when the officer is relaxing at home he/she may be prevented from simply removing his/her holster without first removing the firearm from the holster then unloading it and then placing it in a separate safety locking device that would prevent others in the home from gaining access to it. This is inconvenient and time consuming. Also when traveling it is not practical to carry a separate locking device for storage of the firearm.

Thus, it would be advantageous to provide a holster and locking mechanism capable of engaging the trigger and trigger guard of a firearm to securely constrain the firearm within the holster, and yet have it accessible in an emergency situation merely by disengaging the lock component of the holster freeing the firearm for use.

Similarly, it would be advantageous to invent a firearm securing mechanism capable of operating as a holster to secure the firearm within the holster during strenuous physical activity such as running, climbing barriers and fences, and other activities commonly associated with the duties of law enforcement officers.

SUMMARY OF THE INVENTION

The present invention is directed to a security locking device for a firearm. The locking device is primarily designed to be incorporated into a holster, which may be of any suitable configuration such as those available from a variety of sources.

A preferred embodiment of the device comprises a housing having a slot form therein and configured to receive the trigger and trigger guard portion of the firearm. The side opposite the ball is tapered to allow easier insertion of the trigger guard and to allow the trigger guard to contact the center of the ball at a greater angle. Also a locking mechanism for prevention of operation of and removal of the firearm from the holster. There are also two wings or ears protruding from either side of the slot to further contain the trigger guard and trigger area and to facilitate attachment of the leather or plastic holster to the device.

The locking mechanism is contained within a compartment in the housing and further comprises a locking assembly operably attached to a locking bar.

On one side of the slot, that receives the trigger guard, there is a channel at an angle to the housing. This channel contains the ball with pins. There is another channel parallel to and on either side of the ball channel that the pins ride in. Another channel parallel to and further out from the center of the ball channel contains the springs.

The channel that the ball is contained in is at an oblique angle to the slot and housing to allow sufficient room for movement of the ball within the housing and to allow the side walls of the housing to be kept as narrow as possible so it can be incorporated into the slim lines of a holster.

The ball contains pins, protruding from its poles, that ride in the channel parallel to the channel it is contained in. The channel that contains the ball is slightly larger than the diameter of the ball so it does not touch the walls of the channel. The pins ride in their channel and carry the ball. The springs apply pressure to the pins and this in turn applies pressure to the ball biasing it to the open end of its channel. Therefore the ball is held at the open end of its channel by the springs this causes the ball to protrude into the slot that receives the trigger guard. When the lock is not engaged this helps hold the firearm in place but also allows its easy removal.

The locking mechanism also consists of a locking bar and pin. The locking bar moves up and down in its channel behind and aligned with the closed end of the ball channel. When the bar is in the locked position it protrudes into the channel that contains the ball preventing the ball from moving and forcing it to the open end of its channel.

The locking mechanism further comprises a cam plate and cam that attach to the key lock that when rotated moves the bar up or down in its channel. The bar is connected to the cam by a pin that rides in the cam.

It is an objective of the present invention to provide a locking device for a firearm comprising a housing having a slot formed therein and configured to receive the trigger guard of a firearm in a manner consistent with the normal way in which a firearm is placed into or removed from a holster.

It is an objective of the present invention to provide a locking device for a firearm comprising a housing having a slot formed therein and a locking mechanism for retaining the trigger guard portion of the firearm within the slot to prevent the operation thereof.

These and other objects, features and advantages shall become apparent after consideration of the description and drawings set forth herein. All such objects, features and advantages are contemplated to be within the scope of the present invention even though not specifically set forth herein.

DETAILED DESCRIPTION OF THE PREFERRED EMBODIMENTS

Figure 1:
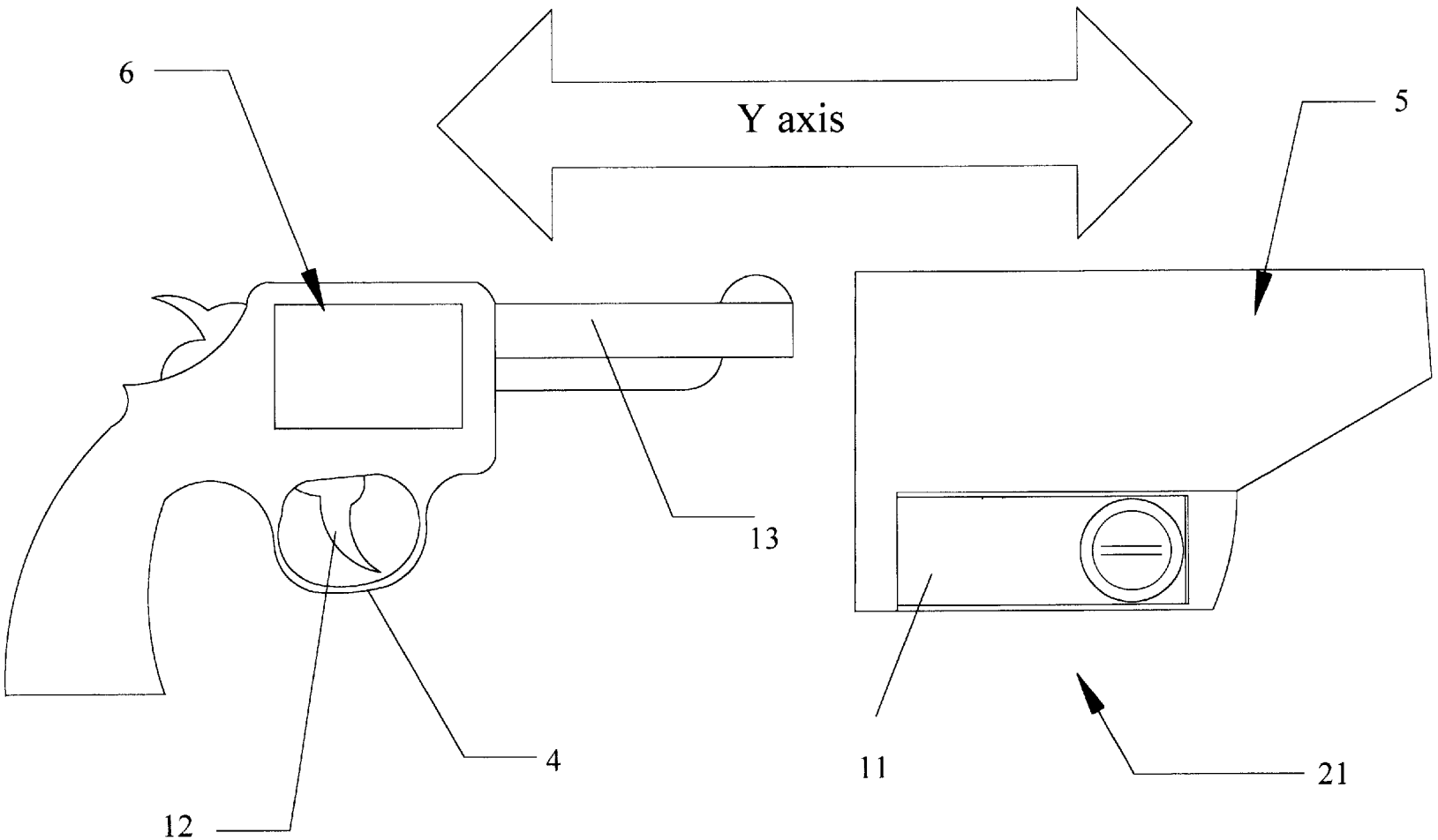
FIG. 1 is a side view of a firearm and the invention with a holster. The arrow indicates the motion required to insert or remove the firearm from the holster.
Figure 2:
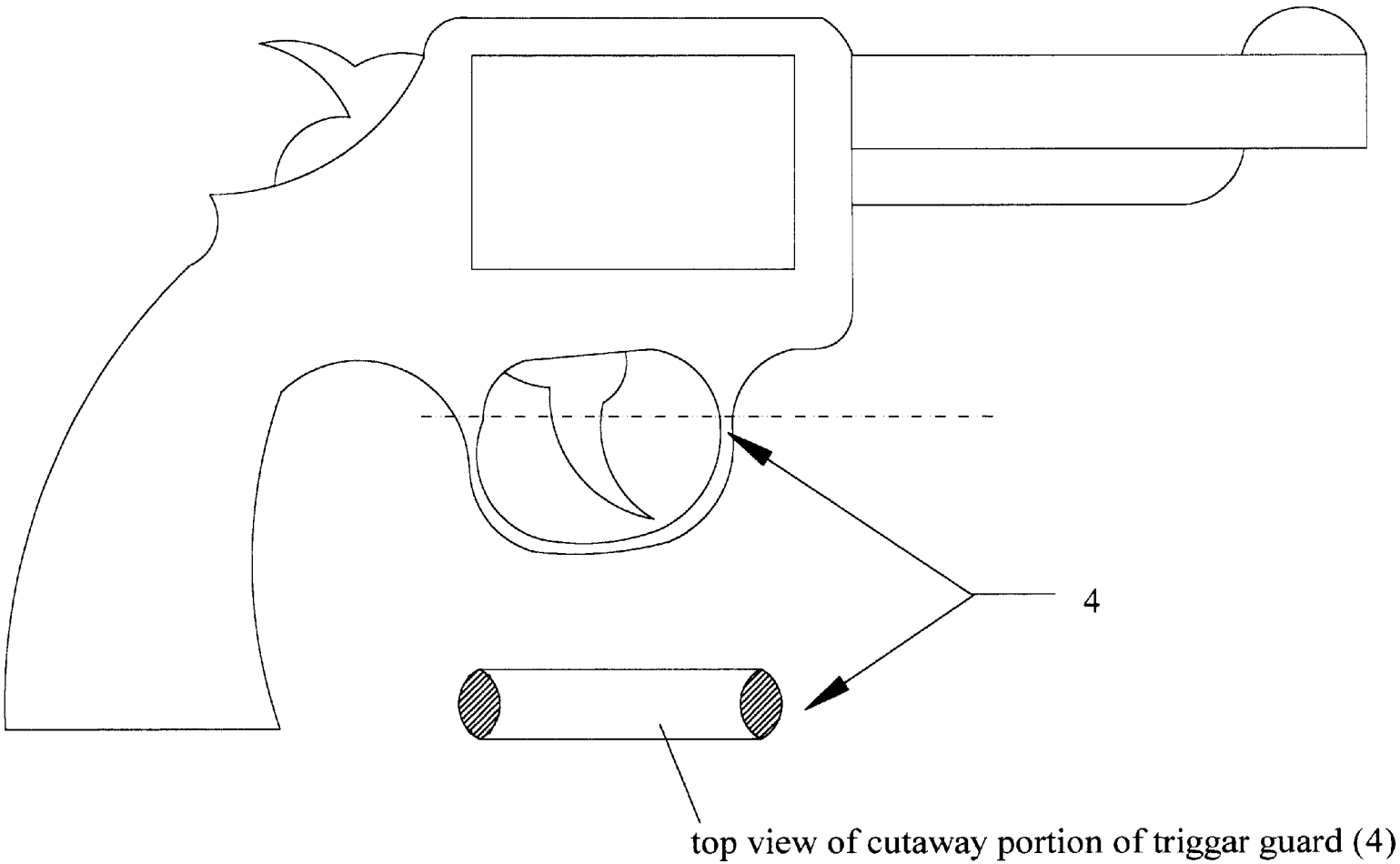
FIG. 2 shows a firearm and a dotted line to indicate where the cutaway of the trigger guard is preformed. The drawing below the firearm shows a top view of the cutaway portion of the trigger guard.
Figure 5:
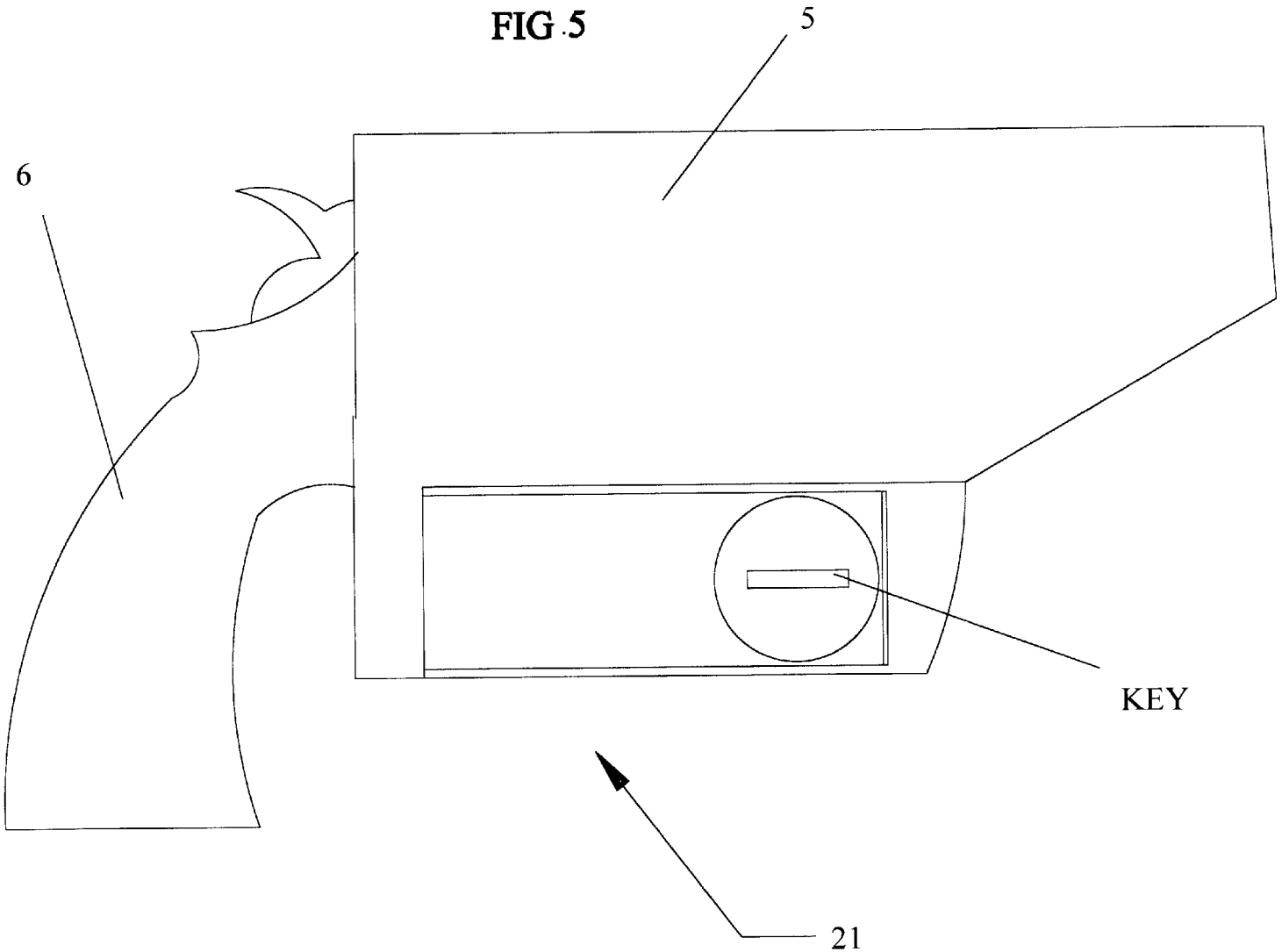
FIG. 5 is the firearm as it would appear in the holster with the invention.
Figure 6:
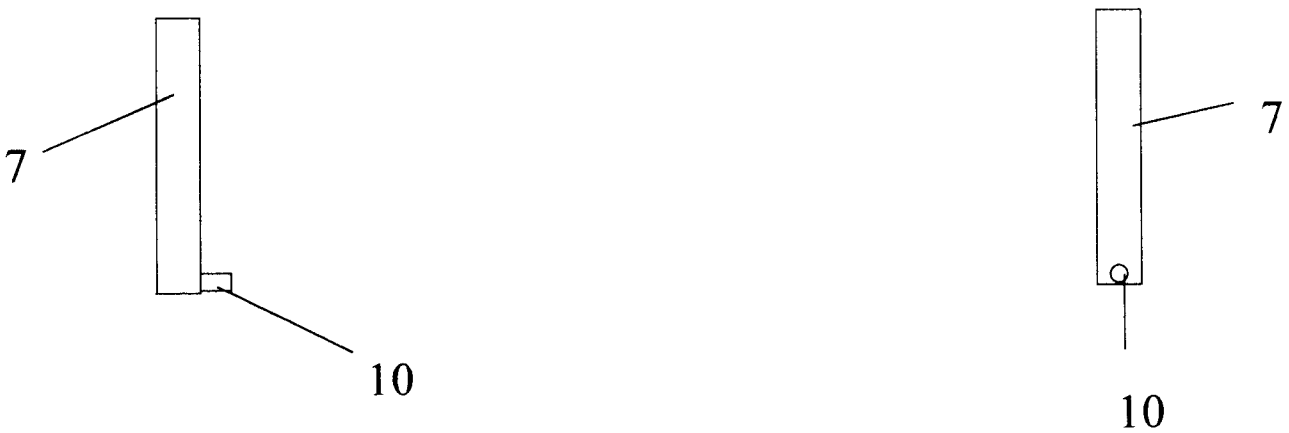
FIG. 6 is the locking bar.
Figure 7:
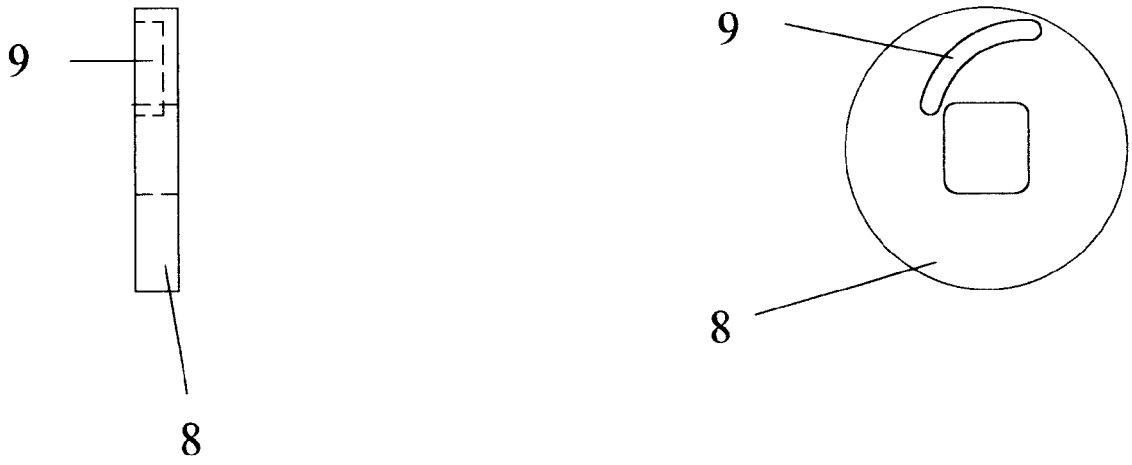
FIG. 7 is the cam plate and cam.
Figure 8:
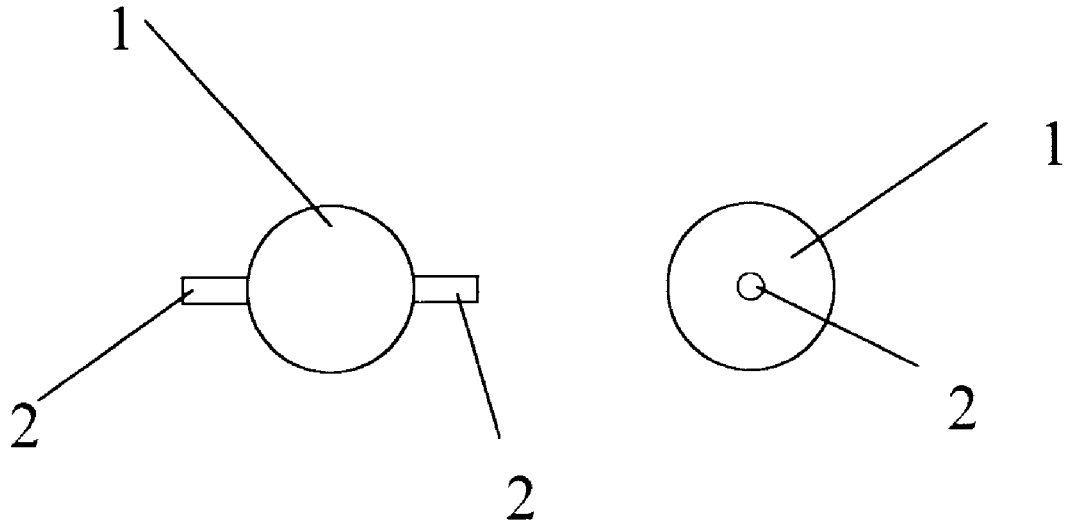
FIG. 8 is the ball with pins.
Figure 9:
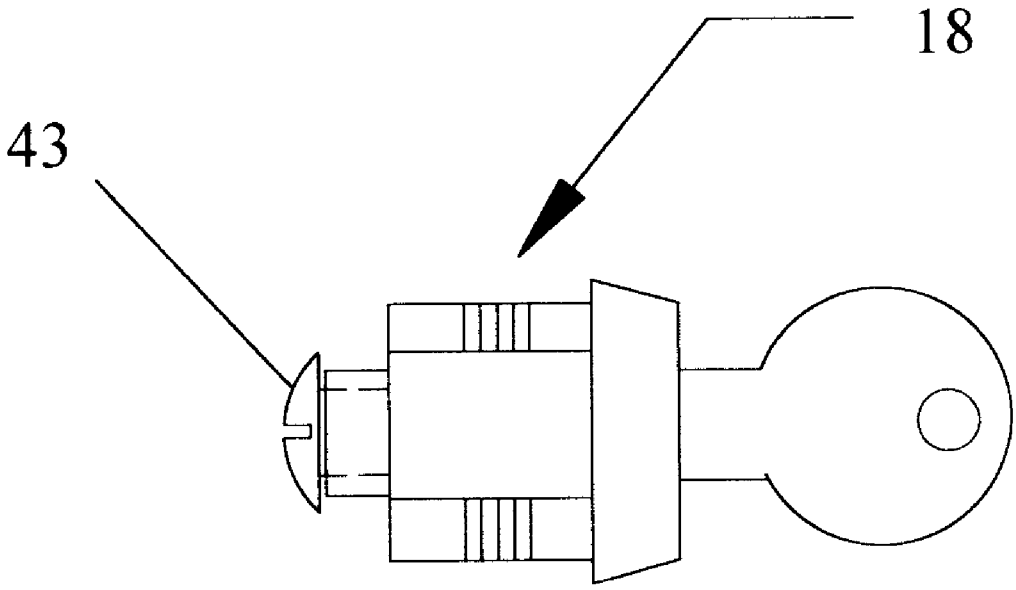
FIG. 9 is the key and lock.

With reference to FIG. 1 a firearm 6 having a barrel 13 a trigger guard 4 and a trigger 12 is shown positioned above a holster 5. The arrow shows the motion required to place the firearm 6 into or remove it from the holster 5 and the invention 11. Reference to FIG. 5 the firearm 6 is in the holster 5 and in operable engagement with the embodiment of the locking device of the present invention 11. The locking device of the present invention is configured to surround the trigger guard 4 and the trigger 12 of the firearm 6 to prevent operation thereof.

Figure 4:
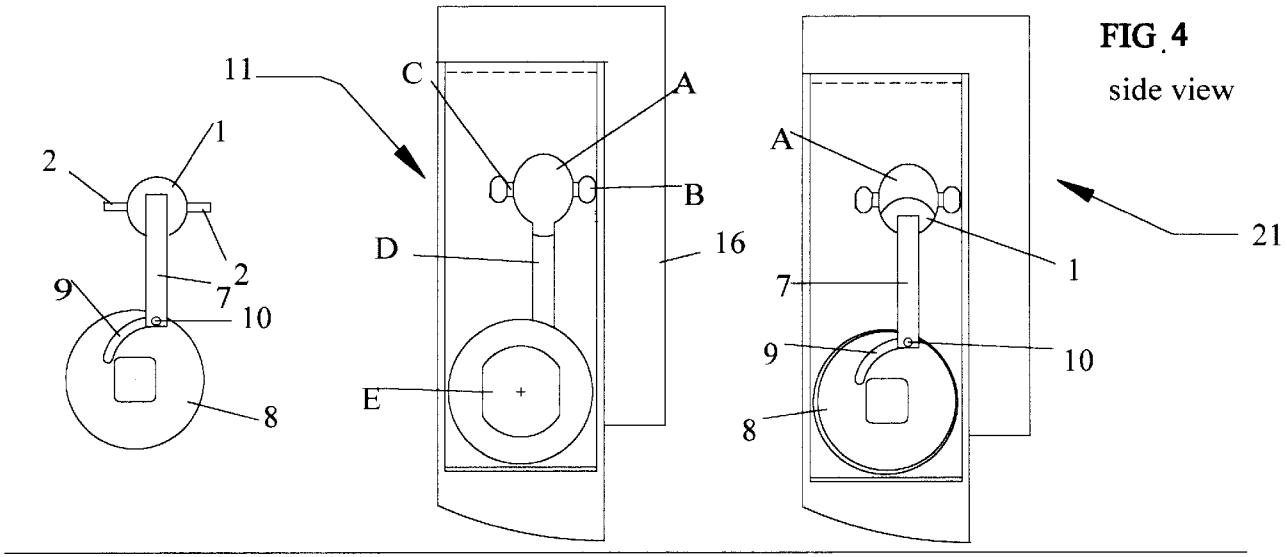
FIG. 4 shows a side view of the invention in the locked position, from left to right, the moving parts, the main body then the combination of the moving parts and the body.
Figure 4A:
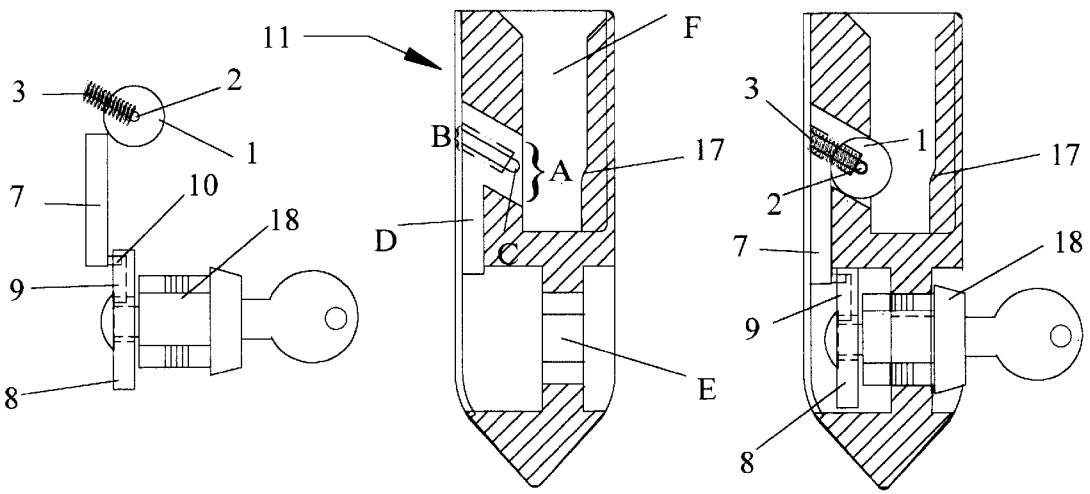
FIG. 4A is a front view of the invention in the locked position showing, from left to right, the moving parts, a cutaway view of the body and the combination of the moving parts and body.

Reference FIG. 4 and FIG. 4A the locking body 11 contains a channel A that contains the ball 1. Attached to the balls poles are two pins 2, the pins ride on and in channel C. In channel B there are springs 3. The springs 3 apply pressure to the pins 2 and that pressure is in turn applied to the ball 1. This constant pressure biases the ball 1 to the open end of channel A which extends into slot F which is where trigger guard 4 is placed (see FIG. 10). As trigger guard 4 moves down into slot F it contacts ball 1 at an oblique angle. As the firearm 6 and the trigger guard 4 are moved further down into the holster 5 the ball moves back in its channel A applying pressure to and compressing the springs 3 through the pins 2. As the trigger guard continues its downward travel it contacts taper 17 that narrows slot F so the front half of trigger guard 4 is contained in the narrowest part of slot F. As the front part of trigger guard 4 passes beyond and below the ball 1 the springs 3 apply pressure to pins 2 moving ball 1 to the open end of channel A (see FIG. 11) so that the ball 1 is now above and behind the front part of the trigger guard 4.

Figure 3:
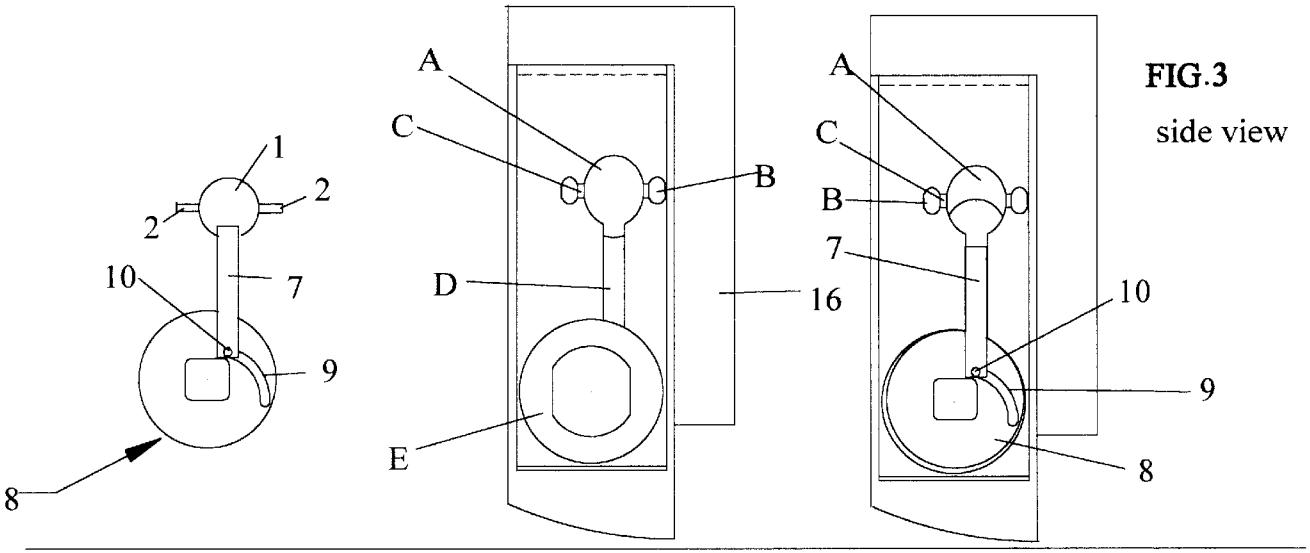
FIG. 3 shows a side view of the invention in the unlocked position, from left to right, the inventions moving parts, main body, then the parts in combination with the body.
Figure 3A:
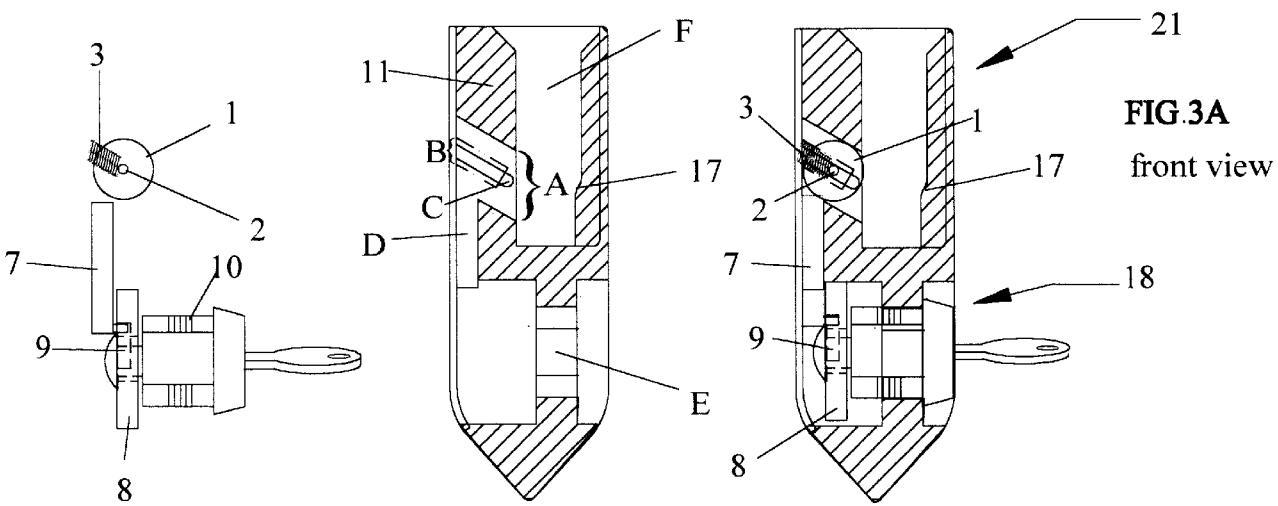
FIG. 3A is a front view of the invention in the unlocked position showing, from left to right, the inventions moving parts, the cutaway of the main body then the combination of the moving parts and the body.
Figure 10:
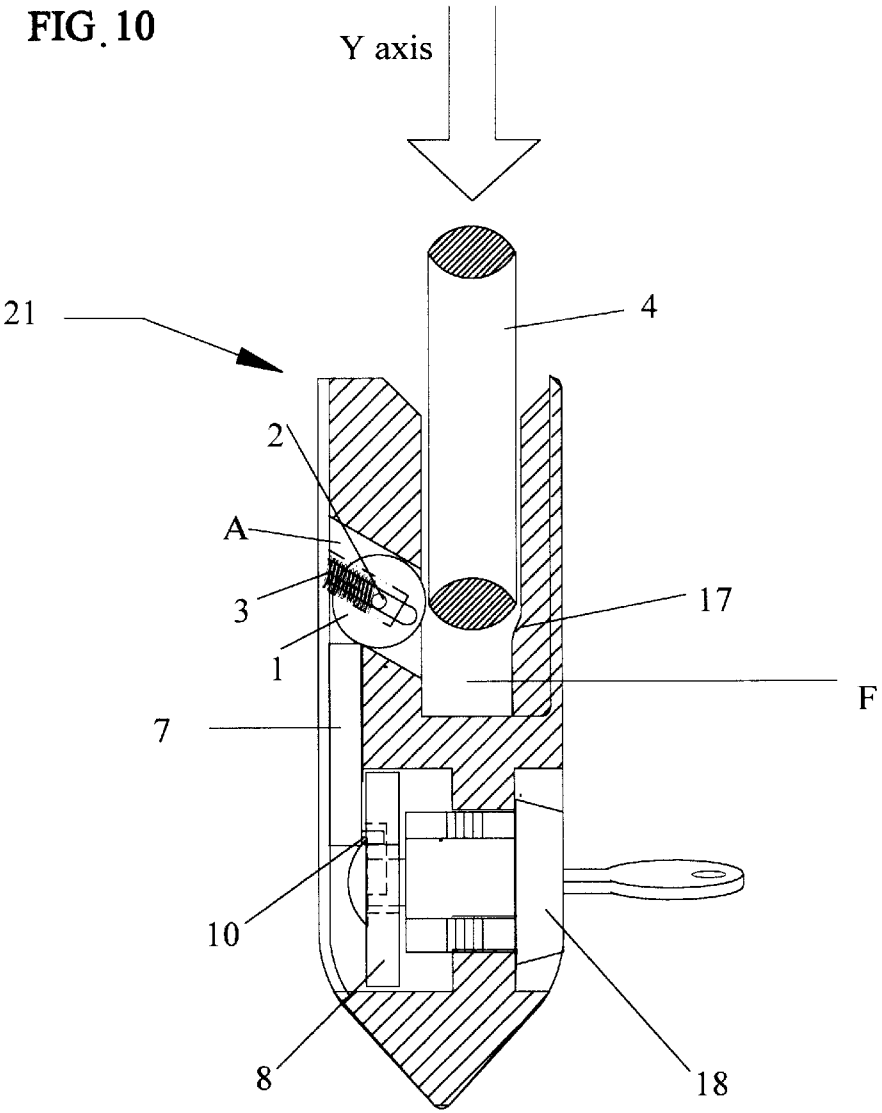
FIG. 10 shows the cutaway view of the body of the invention in combination with the moving parts in the unlocked position and the top view of the cutaway portion of the trigger guard.
Figure 11:
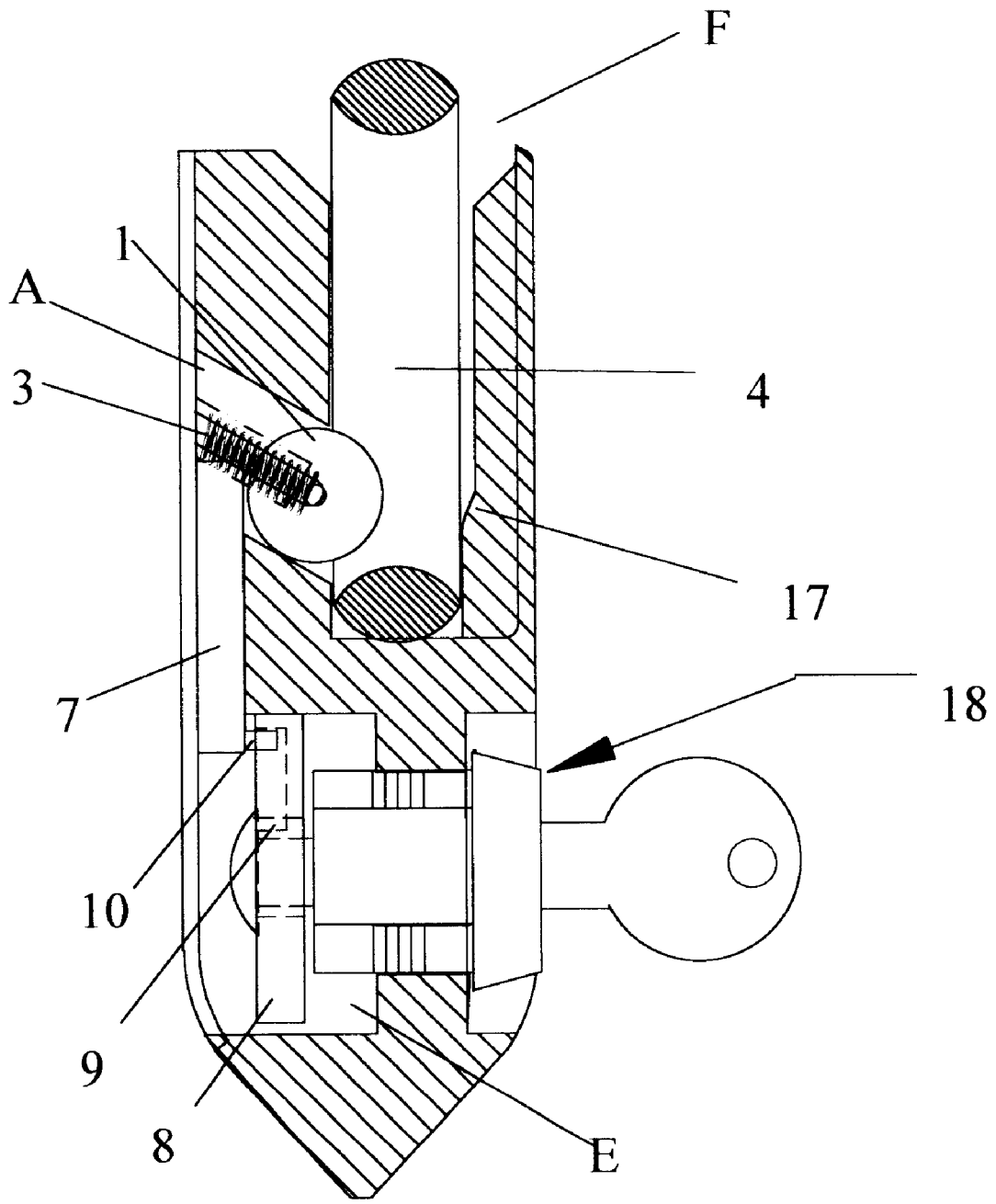
FIG. 11 shows the cutaway view of the body of the invention in combination with the moving parts in the locked position and the top view of the cutaway portion of the trigger guard.

Reference FIGS. 10, 3 and 3A when the invention is not locked the removal of the firearm 6 (movement away from or out of slot F) and its associated trigger guard 4 are slightly impeded by ball 1 and the pressure of springs 3 but not prevented Reference FIGS. 11, 4 and 4A when the front of the trigger guard 4 is in the narrowest part of slot F as described previously and the lock bar 7 is moved up in its channel D by the rotation of cam plate 8 rotating cam 9 in which pin 10 is riding causing locking bar 7 to move into channel A behind ball 1 preventing the balls rearward travel therefore the ball 1 blocks slot F preventing the removal of the trigger guard 4 from slot F and also the attached firearm 6 from holster 5.

Reference FIGS. 4, 4A the key lock 18 in slot E is attached to the cam plate 8 which rotates cam 9 and causes pin 10 and locking bar 7 to move vertically (up or down) in channel D.

Reference FIGS. 10, 3 and 3A when the invention 11 is unlocked locking bar 7 is at its lowest point of travel in channel D. When the invention 11 is locked reference FIG. 11,4 and 4A) locking bar 7 is at its highest point of travel in channel D and is protruding into channel A.

Reference FIG. 3 and 4 there are two wings or ears 16 protruding from the front of the invention 11. They are used to form a more complete enclosure for the trigger 12 and trigger guard 4 and to create an area where the leather or plastic holster 5 is attached.

Figure 12:
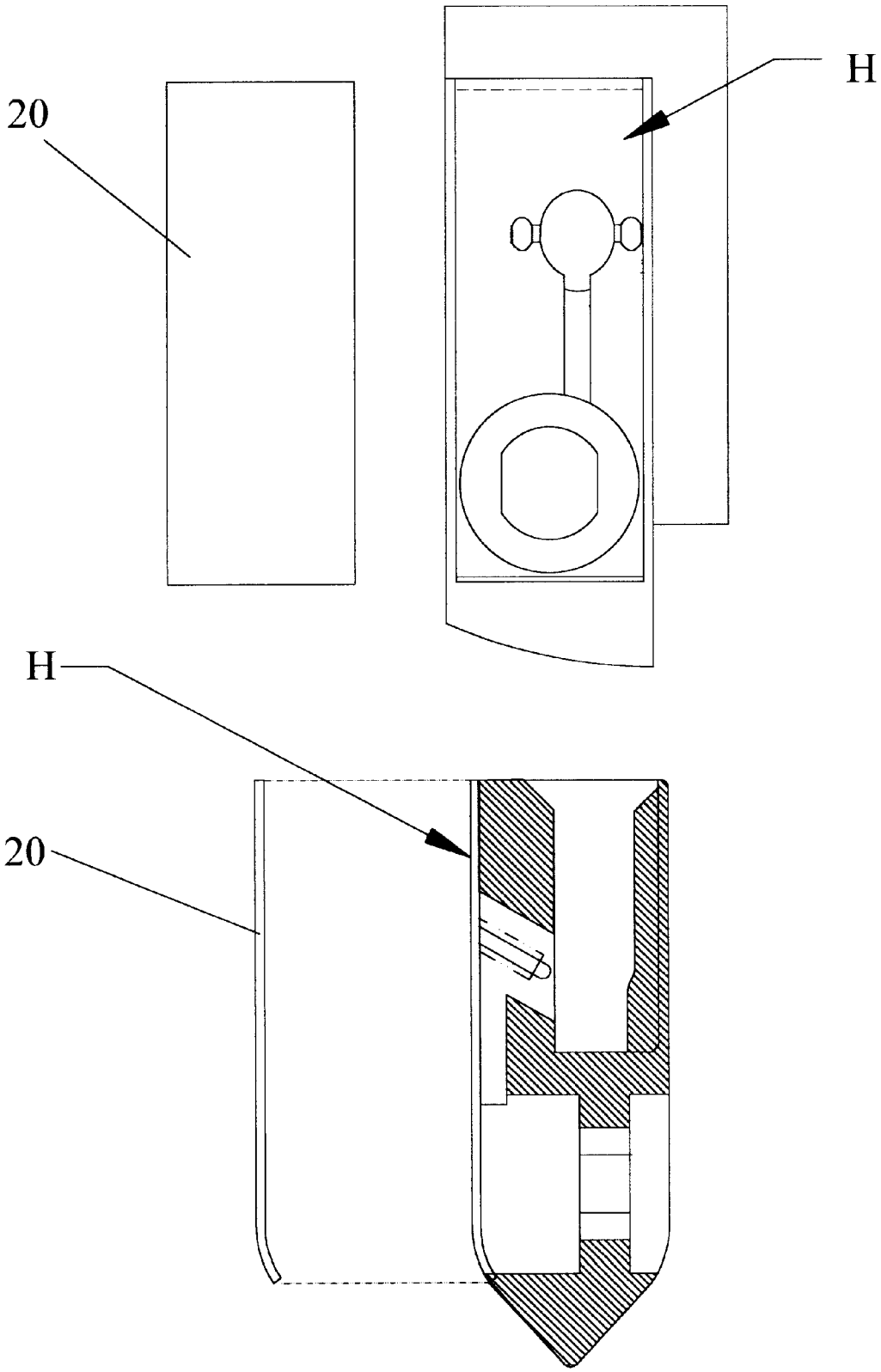
FIG. 12 shows the cover plate that is used to enclose the channels for the ball, springs, pins, locking rod and key lock.

Reference FIG. 12 the cover plate 20 is placed over area H to cover and enclose the ball channel A the spring channel B the pin channel C the locking rod channel D and the lock channel E. The cover plate 20 causes locking rod 7 to be completely contained within channel D and provides a backstop for the locking rod 7 when it is in the locked position in the ball channel A. The cover plate 20 also is the backstop for springs 3 in the channel B.

What is claimed is:

1. A safety mechanism for a firearm, comprising:

a housing having five channels and a tapered slot formed therein to receive a trigger and trigger guard of said firearm, wherein a first of the five channels is centrally located in said housing and has an open end in fluid communication with said slot and a closed end, a second and third channel are parallel and in fluid communication with said first channel and are located on opposite sides of said first channel in said housing, and a fourth and fifth channel are parallel and in fluid communication with said second and third channels and are located on opposite sides of said second and third channels from said first channel in said housing;

a ball, having two pins disposed on opposite sides of said ball on an axis through a center of the ball, disposed in said first channel and said pins are disposed in said second and third channels, and said fourth and fifth channels each accommodate a spring;

a locking mechanism disposed within said housing, wherein said locking mechanism further comprises a lock assembly operably connected to a locking rod, wherein said locking rod is operable between a locked position in which said locking rod is positioned into a space behind said ball in said first channel and an unlocked position in which said locking rod is removed from the space behind said ball.

2. The safety mechanism of claim 1, wherein:

said springs apply pressure to said pins.

3. The safety mechanism of claim 1, wherein:

said springs apply pressure to said pins which in turn apply pressure to said ball, biasing said ball to said open end of the first channel toward said slot.

4. The safety mechanism of claim 1, wherein:

when said locking rod is in the unlocked position, the ball is in an unlocked position in which said trigger guard is allowed to enter and exit the slot with only a slight resistance.

5. The safety mechanism of claim 4, wherein:

when said locking rod is in the locked position, the ball is in a locked position which prevents the trigger guard from exiting the slot when the safety mechanism is locked on the firearm.

6. The safety mechanism of claim 1, wherein:

said lock assembly further comprises a pin attached to said locking rod, where the pin rides in a cam that is operably attached to said locking mechanism said pin being slidably received within said cam.

7. The safety mechanism of claim 1, wherein:

the housing has wings and is disposed within a holster whereby the trigger guard of said firearm is prevented from exiting the holster when said locking rod is in the locked position.

8. The safety mechanism of claim 1, wherein:

the locking mechanism comprises a key operated lock.

* * * * *